US005899454A

United States Patent [19]

Eddy et al.

[11] Patent Number: 5,899,454

[45] Date of Patent: May 4, 1999

[54] RAMP WITH INTEGRAL BALL DEFLECTOR FOR PINBALL GAMES

[75] Inventors: Brian R. Eddy, Addison; Robert C. Friesl; Benedicto Rodriquez, both of Chicago, all of Ill.

[73] Assignee: Williams Electronics Games, Inc., Chicago, Ill.

[21] Appl. No.: 08/956,954

[22] Filed: Oct. 23, 1997

[51] Int. Cl.[6] ..... A63F 7/30

[52] U.S. Cl. ..... 273/127 C; 273/127 R

[58] Field of Search ..... 273/118, 119, 273/121, 127 R, 127 C; 14/69.5

[56] References Cited

U.S. PATENT DOCUMENTS

| | | | |
|---|---|---|---|
| 4,606,545 | 8/1986 | Ritchie . | |
| 4,934,699 | 6/1990 | Kaminkow et al. | 273/121 A |
| 5,120,058 | 6/1992 | Trudeau et al. | 273/121 R |
| 5,123,647 | 6/1992 | Lawlor et al. . | |
| 5,149,094 | 9/1992 | Tastad . | |
| 5,405,144 | 4/1995 | Ritchie et al. | 273/121 A |
| 5,480,149 | 1/1996 | Trudeau | 273/121 A X |
| 5,507,488 | 4/1996 | Eddy et al. | 273/127 R |
| 5,516,103 | 5/1996 | Lawlor et al. | 273/121 A X |

*Primary Examiner*—Raleigh W. Chiu
*Attorney, Agent, or Firm*—Rudnick & Wolfe

[57] ABSTRACT

A ramp with an integral ball deflector is positioned upon the playfield of a pinball game with its entrance approximately level with the playfield. A ball deflector having the shape of a triangle is mounted upon the bottom of the ramp with its widest portion near to the ramp entrance. The hypotenuse of the ball deflector defines a ball deflection surface. When a game ball rolls down the ramp, such as during roll back it is directed away from one of the side walls of the ramp by the ball deflection surface so that it later avoids an undesirable location on the playfield. A bifurcated entrance plate is connected between the ramp entrance and the playfield so that the ball deflector has a minimal effect upon a game ball entering the ramp.

6 Claims, 2 Drawing Sheets

RAMP WITH INTEGRAL BALL DEFLECTOR FOR PINBALL GAMES

BACKGROUND

The invention relates generally to amusement devices in the form of rolling ball or pinball games and, more particularly, to a ramp with an integral ball deflector for such games.

A typical pinball game includes a playfield that is inclined so that a game ball rolling thereon is directed by gravity towards the player. This movement is counteracted when the game ball comes into contact with pivoting flippers that are controlled by the player. At least one pair of these flippers are typically positioned upon the portion of the playfield nearest to the player and allow the player to propel and direct the game ball at various play features mounted upon the playfield. By engaging the play features with the game ball the player is able to score points and control play of the game. Centered between the flippers at the very bottom of the inclined playfield, or in the bottom side wall bordering the playfield, is typically a ball return passage or "outhole" into which the game ball drops when the player is unsuccessful at contacting it with the flippers. When the player's allotted number of game balls have entered the outhole, the game is over.

Many pinball games include ramps to define paths of travel for the game ball that lead to game features such as elevated targets and the like. These ramps feature one end that is level with the playfield and directed towards a flipper or pair of flippers. This orientation is necessary if the player is to have a reasonable chance of directing the game ball into and up the ramp via the flippers.

Such ramp orientation, however, may present a problem when a game ball rolls down the ramp. More specifically, when a game ball enters the ramp with a velocity sufficient to propel it only partway up the ramp, the game ball will roll back down the ramp. Because of the orientation of the ramp, the game ball may consistently be directed at the outhole, or possibly some other undesirable location, thus denying the player a reasonable chance of contacting the game ball with the flippers. As a result, game play is prematurely terminated as the player's game ball supply is rapidly exhausted. This results in player frustration so that player enjoyment, and thus game appeal, is decreased.

Accordingly, it is an object of the present invention to provide a ramp with an integral ball deflector so that the ramp may be accessed by a player without game ball roll backs being directed into the outhole or some other undesirable location.

SUMMARY

The present invention is directed to a ramp with an integral ball deflector for a pinball game. The ramp features an entrance that is approximately level with the playfield so that the game ball may enter the ramp when directed thereto by the pinball flippers.

A ball deflector is disposed along one side of the ramp. The ball deflector has a triangular shape with the hypotenuse forming a ball deflection surface. The ball deflector is mounted so that its wider portion is near the ramp opening. As a result, a ball rolling down the ramp, during roll back, is directed away from a ramp sidewall by the ball deflection surface. This directs the ball, upon exiting the ramp, away from the outhole, or other undesirable location, and towards the pinball game flippers.

An entrance plate is mounted at the entrance to the ramp and has a solid portion and a divided portion with the latter featuring a pair of flaps. The solid portion of the entrance plate is connected to the playfield while one flap is disposed upon the ball deflector. The other flap is disposed upon the bottom of the ramp. The entrance plate minimizes the effect that the ball deflector has upon a ball entering the ramp.

For a more complete understanding of the nature and scope of the invention, reference may now be had to the following detailed description of embodiments thereof taken in conjunction with the appended claims and accompanying drawings.

DESCRIPTION

Figure 1:
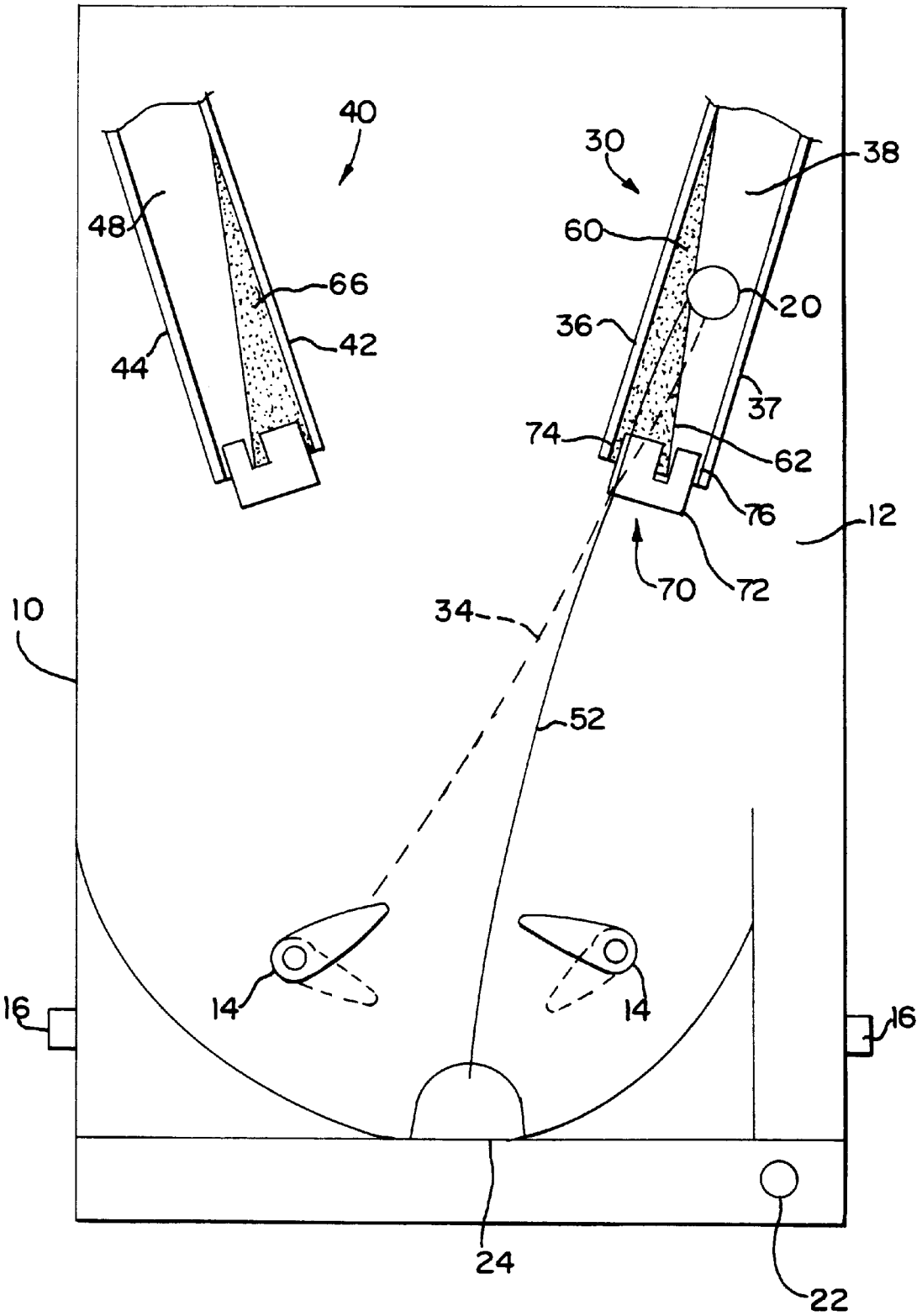
FIG. 1 is a top plan view of a pinball game including embodiments of the ramp with integral ball deflector of the present invention.

Referring to FIG. 1, a pinball game is shown that features embodiments of the ramp with integral ball deflector of the invention The pinball game is housed in a game cabinet 10 and features a playfield 12. The playfield is inclined so that a ball positioned thereon is directed by gravity towards the player of the game. A pair of pivoting flippers 14 are positioned at the bottom of the inclined playfield 12 and are actuated by the player via manipulation of flipper control switches 16. As is known in the art, game ball 20 is introduced onto playfield 12 by way of a shooter 22 or its equivalent. After being "shot" onto the playfield 12, ball 20 rolls towards the player by the force of gravity. The player actuates flippers 14 so that they contact ball 20 thus propelling and directing it towards targets on the playfield. If the player is unsuccessful in contacting the ball with flippers 14, the ball drops into ball return passage or outhole 24. Play of the game continues until all of the player's allotted game balls have passed into the outhole 24.

As shown in FIG. 1, disposed upon playfield 12 are one or more ramps, indicated generally at 30 and 40. Ramp 30 is positioned upon playfield 12 so that a ball 20 may be propelled by contact with one of the flippers 14 to the ramp entrance 32 (FIG. 2), and up the ramp, along a path indicated by dashed line 34. Ramp 30 features side walls 36 and 37 that prevent ball 20 from rolling off of the sides of the ramp bottom 38. The ramp may lead to other portions of the playfield as desired. An additional ramp 40 may be positioned on playfield 12 in a manner similar to ramp 30 to offer the player an additional target. Given the similarities between ramps 30 and 40, the invention will be described below primarily in terms of ramp 30. In addition, it should be noted that the positions shown for ramps 30 and 40 and flippers 14 are for illustrative purposes only and that many alternative locations for both types of components on playfield 12 are possible.

Figure 2:
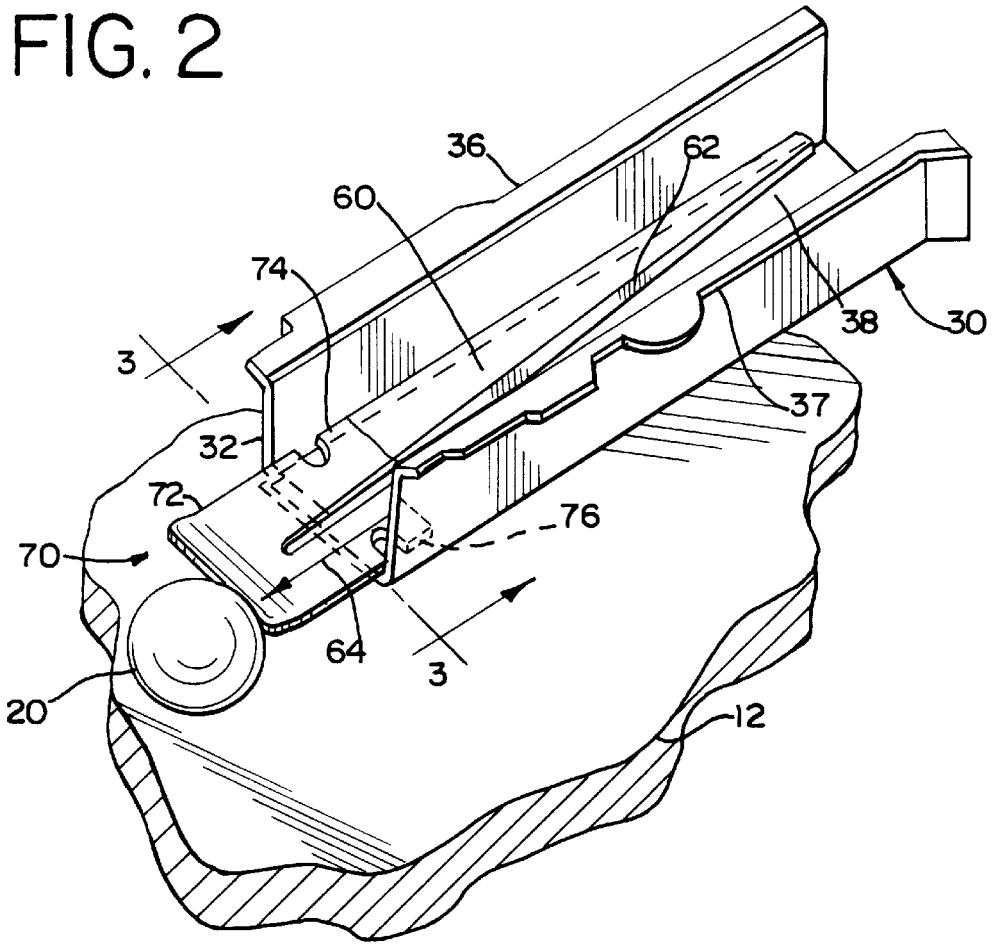
FIG. 2 is an enlarged perspective view of the ramp with integral ball deflector of FIG. 1.

Referring to FIG. 2, the lower end of ramp 30 is positioned upon playfield 12, while the other end is elevated above playfield 12 so that at least a portion of ramp 30 is inclined. As is known in the art, the elevated end of ramp 30 may lead to additional play features such as ball passages, targets, bells and the like. As such, in order for the game ball to access these features, the player must contact ball 20 with flippers 14 (FIG. 1) so that the ball has the direction and velocity necessary to successfully negotiate the ramp 30.

In many instances, however, the player will propel the ball with a velocity that is insufficient to successfully negotiate ramp 30. This may be due to improper timing with respect to the activation of flippers 14 or the direction of the propelled ball may be such that it ricochets off of ramp side walls 36 or 37 thus losing velocity and energy. In such instances, the ball will climb only part way up the ramp, stop and then "roll back" towards the player. In existing pinball machines, the ball would normally follow a path along one wall of the ramp so as to be consistently directed toward the same spot on the playfield. In many situations, this will be an undesirable location, such as outhole 24. An example of such a path is illustrated by line 52 in FIG. 1. A ball traveling this path is difficult or impossible to contact with flippers 14 as it travels towards outhole 24. As a result, every time a player attempts to negotiate ramp 30, he or she faces the risk that a game ball will be lost. It should be noted that outhole 24 represents only one of several possible undesirable locations on a pinball game playfield contemplated by the invention.

To increase play time and enjoyment there is provided, according to the invention, a ball deflector 60. Ball deflector 60 is attached to the floor 38 of the ramp and has the shape of a triangle with its hypotenuse forming a ball deflection surface 62. Ball deflector 60 is oriented so that its widest portion is at the entrance 32. Accordingly, a ball traveling down ramp 30, during roll back, is directed away from the sidewall 36 by ball deflection surface 62. This path is indicated by arrow 64 in FIG. 2. Ball 20 thus directed rolls down playfield 12 in a manner that allows the player to easily contact it with one of the flippers 14 so that game play may continue.

As illustrated in FIG. 1, ramp 40 also has a ball deflector 66 positioned upon its bottom 48. Similar to ramp 30, a ball rolling back down ramp 40, without deflector 66, would follow a path along wall 42 and be guided into outhole 24 through a path similar to path 52. Accordingly, ball deflector 66 is mounted on the ramp bottom 48 so that the ball is guided away from wall 42. A comparison of ramps 30 and 40, and their respective ball deflectors, reveals that the orientation of the ball deflectors is reversed as dictated by the positions of the ramps on the playfield.

Figure 3:
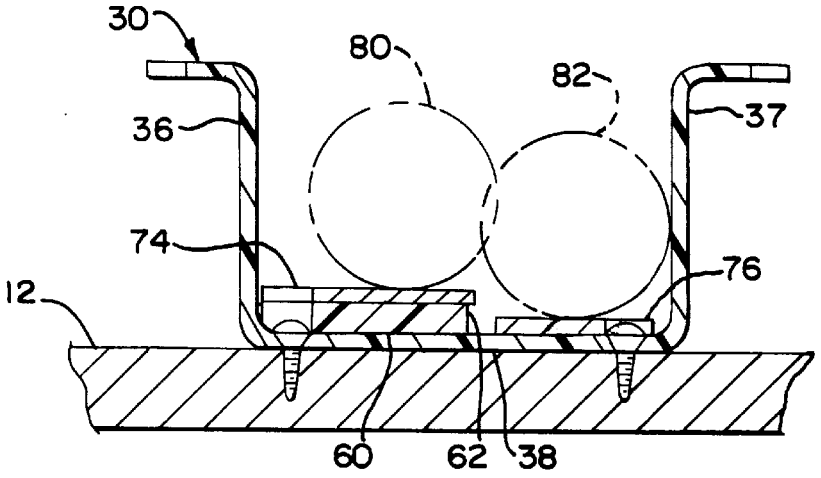
FIG. 3 is a sectional view of the ramp with integral ball deflector of FIG. 2 taken along line 3—3.

As shown in FIGS. 1, 2 and 3, positioned at the entrance 32 of ramp 30 is an entrance plate, indicated generally at 70. Entrance plate 70 has a minimal thickness and features a solid portion 72 and a divided portion, which features a pair of flaps 74 and 76. Solid portion 72 rests upon or is secured to playfield 12 while one of the flaps 74 is positioned upon the ball deflector. The other flap 76 rests upon the exposed portion of the bottom 38 of ramp 30.

Entrance plate 70 minimizes the effect that ball deflector 60 has on a ball entering ramp 30. As shown in FIG. 3, a ball initially entering ramp 30, indicated at 80, will travel up entrance plate 70 and onto the top of ball deflector 60. As such, the ball 80 is not materially affected by ball deflection surface 62. Referring to the path indicated by dashed line 34 in FIG. 1, as ball 80 continues to roll up the ramp, it will eventually drop off of ball deflector 60 and onto the bottom 38 of ramp 30. If the ball has sufficient velocity to climb ramp 30, the ball will then proceed as if ball deflector 60 did not exist. If the ball does not have the velocity to negotiate ramp 30, however, it will roll back down the ramp along the bottom 38 of ramp 30, as indicated by ball 82 in FIG. 3, along a path defined by ball deflection surface 62.

As shown in FIG. 3, ball deflector 60 should have a thickness that is great enough to define a ball deflection surface 62 that affects the path of a ball during roll back. The thickness of ball deflector 60 should be limited, however, so that its affect on a ball traveling up the ramp 30 is minimized. Ball deflector 60 is preferably made of plastic, but any material having the desired thickness may alternatively be used. Ball deflector 60 is attached to the bottom 38 of ramp 30 with flush mounted rivets, adhesive or the like. The entrance plate 70 is preferably constructed of tin, but any thin flexible material may alternatively be used. Entrance plate is secured to playfield 12, ball deflector 60 and the bottom 38 of ramp 30 with flush mounted rivets, adhesive or the like. As is known in the art, ramps such as ramp 30 are typically constructed of plastic, but a variety of alternative materials may be used.

While the preferred embodiments of the invention have been shown and described, it will be apparent to those skilled in the art that changes and modifications may be made therein without departing from the spirit of the invention, the scope of which is defined by the appended claims.

What is claimed is:

1. A ramp with an integral ball deflector for a pinball game, where the pinball game has an inclined playfield for supporting the movement of a game ball thereon, comprising:

a) a ramp adapted to be disposed on said playfield including an entrance, side walls and a bottom so that a game ball may enter and travel on said ramp;

b) a ball deflector secured to said ramp, configured to deflect a ball rolling down the ramp away from a predetermined location on said playfield; and c) said ball deflector having a top upon which a game ball may roll as it travels up said ramp.

2. The ramp of claim 1 further comprising an entrance plate having a solid portion and a divided portion featuring a first flap and a second flap with said solid portion adapted to be disposed upon the playfield, said first flap disposed upon the ball deflector and said second flap disposed upon said ramp bottom whereby a game ball traveling up the ramp is substantially unimpeded by the ball deflector.

3. The ramp of claim 1 wherein the ball deflector is configured as a right triangle with its hypotenuse defining a deflection surface.

4. A ramp with an integral ball deflector for a pinball game, where the pinball game has an inclined playfield for supporting a game ball thereon, the ramp with integral ball deflector comprising:

a) a ramp having a bottom with a pair of side walls connected to opposing edges of said bottom and an entrance so that the game ball may be directed onto the ramp for travel thereon; and b) a ball deflector secured to said ramp having a ball deflection surface configured to deflect a ball rolling down the ramp away from a selected one of said sidewalls whereby a game ball that has insufficient energy to traverse the ramp does not travel to a predetermined, undesirable location on said playfield.

5. The ramp of claim 4 further comprising an entrance plate having a solid portion and a divided portion featuring a first flap and a second flap with said solid portion adapted to be disposed upon the playfield, said first flap disposed upon the ball deflector and said second flap disposed upon the bottom of the ramp whereby a game ball traveling up the ramp is substantially unimpeded by the ball deflector.

6. The ramp of claim 4 wherein the ball deflector is configured as a right triangle with the ball deflection surface forming a hypotenuse thereof and a widest portion of the ball deflector positioned proximate said ramp entrance.

* * * * *